US007271538B2

(12) United States Patent
Sugimoto et al.

(10) Patent No.: US 7,271,538 B2
(45) Date of Patent: Sep. 18, 2007

(54) PLASMA DISPLAY PANEL HAVING A REDUCED IMPURITY GAS CONTENT

(75) Inventors: Kazuhiko Sugimoto, Kyoto (JP); Masaki Aoki, Osaka (JP); Yuichiro Miyamae, Osaka (JP); Keiji Horikawa, Kyoto (JP); Junichi Hibino, Kyoto (JP); Yoshinori Tanaka, Osaka (JP); Hiroshi Setoguchi, Osaka (JP); Izumi Toyoda, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/558,298

(22) PCT Filed: Mar. 8, 2005

(86) PCT No.: PCT/JP2005/003946

§ 371 (c)(1),
(2), (4) Date: Nov. 28, 2005

(87) PCT Pub. No.: WO2005/088668

PCT Pub. Date: Sep. 22, 2005

(65) Prior Publication Data

US 2006/0232207 A1 Oct. 19, 2006

(30) Foreign Application Priority Data

Mar. 11, 2004 (JP) ..... 2004-068598
Mar. 11, 2004 (JP) ..... 2004-068599

(51) Int. Cl.
*H01J 17/04* (2006.01)

(52) U.S. Cl. ..... 313/582; 313/292

(58) Field of Classification Search ..... 313/582–587
See application file for complete search history.

(56) References Cited

U.S. PATENT DOCUMENTS 5,939,826 A 8/1999 Ohsawa et al.

(Continued)

FOREIGN PATENT DOCUMENTS

JP 8-138559 5/1996

(Continued)

OTHER PUBLICATIONS

Masaomi EBE, "2001 FPD Technology Outlook", P615-618.

*Primary Examiner*—Joseph Williams
(74) *Attorney, Agent, or Firm*—Wenderoth, Lind & Ponack, L.L.P.

(57) ABSTRACT

A plasma display panel having an excellent image display quality and high reliability is provided by preventing deterioration of a phosphor due to hydrocarbon gas remaining in the plasma display panel. The plasma display panel includes front panel (50) and rear panel (60) disposed opposing each other, and front panel (50) is provided with a plurality of display electrodes composed of a pair of scan electrodes (6) and sustain electrodes (7), and rear panel (60) has barrier ribs (10) forming discharge cells (11). In the plasma display panel, rear panel (60) includes data electrodes (9) perpendicular to display electrodes composed of a pair of scan electrodes (6) and sustain electrodes (7) on substrate (2), dielectric layer (13) covering data electrodes (9), reflective layer (20) containing an oxidation catalyst and covering at least a part of dielectric layer (13), and phosphor layer (12) covering reflective layer (20).

13 Claims, 6 Drawing Sheets

U.S. PATENT DOCUMENTS

| | | | | |
|---|---|---|---|---|
| 6,100,633 | A * | 8/2000 | Okumura et al. | 313/486 |
| 6,189,579 | B1 | 2/2001 | Tanaka | |
| 2004/0145314 | A1 | 7/2004 | Zukawa et al. | |

FOREIGN PATENT DOCUMENTS

| | | |
|---|---|---|
| JP | 11-329246 | 11/1999 |
| JP | 2000-11885 | 1/2000 |
| JP | 2001-332179 | 11/2001 |
| JP | 2002-324492 | 11/2002 |
| JP | 2002-372919 | 12/2002 |
| JP | 2003-281994 | 10/2003 |
| JP | 2003-303555 | 10/2003 |
| JP | 2004-179157 | 6/2004 |
| WO | 00/33347 | 6/2000 |

* cited by examiner

PLASMA DISPLAY PANEL HAVING A REDUCED IMPURITY GAS CONTENT

This application is a U.S. national phase application of PCT international application PCT/JP2005/003946.

TECHNICAL FIELD

The present invention relates to a plasma display panel (hereinafter, referred to as "PDP") used for, for example, a television, a large-screen monitor, and the like, and particularly to a PDP in which impurity gas is reduced.

BACKGROUND ART

Recently, in color display devices used for displaying images on computers, televisions, and the like, a PDP display device using a PDP has draw attention as a color display device that can realize a large-screen and light weight display device.

A PDP includes a front panel and a rear panel sealed to each other with predetermined discharge space interposed therebetween. On the front panel and the rear panel, an electrode and a dielectric layer, or a barrier rib, a phosphor layer, and the like, are formed respectively by firing a structure containing an organic binder. Among the production processes of a PDP, in particular, in a sealing process for sealing the front panel and the rear panel, an organic binder, etc. contained in a glass frit used as a sealing material is thermally decomposed, so that impurity gas is dispersed inside the PDP. Main components of the impurity gas include water, carbon dioxide, hydrocarbon gas, and the like, and these impurity gases are adsorbed on a phosphor etc. in the PDP and may cause such problems as deterioration of discharge characteristics, degradation of luminance, and the like (disclosed in Japanese Patent Unexamined Publication No. 2003-281994 and FPD Technology Outlook (Electronic Journal, Oct. 25, 2000, pp 615-618)). Therefore, one of the important problems is to reduce impurity gas inside the PDP and to improve the reliability by stabilizing discharge characteristics and suppressing change over time.

As a method of reducing impurity gas inside of such a PDP, a method of providing a getter in an exhaust pipe so as to adsorb impurity gas when the inside of the PDP is exhausted is disclosed in Japanese Patent Unexamined Publication No. 11-329246, and a method of providing a getter inside a PDP so as to adsorb impurity gas is disclosed in Japanese Patent Unexamined Publication Nos. 2002-531918 and 2003-303555.

However, in the above-mentioned conventional method of providing a getter in an exhaust pipe, since discharge gas is injected through the exhaust pipe, the impurity gas exhausted from the inside of the PDP is adsorbed on the inner wall of the exhaust pipe and impurity gas enters the inside of the PDP again together with discharge gas when the discharge gas is supplied. Consequently, removal of impurity gas was not sufficient. Furthermore, in the method of providing a getter inside the PDP so as to adsorb impurity gas, since discharge space is partitioned by barrier ribs, the effect of the getter cannot be allowed to act on the entire region. As a result, a region in which impurity gas remains is generated, thus causing uneven display. Furthermore, a getter is heated during discharging, so that impurity gas may be released into the PDP again. Furthermore, in the method of providing a getter inside an exhaust pipe so as to remove impurity gas, impurity components gradually accumulate in the getter, thus gradually degrading the ability of removing impurity gas. Furthermore, since the main object of a conventional getter or adsorbent is to adsorb and remove water or carbon dioxide among impurity gas, such a getter or adsorbent has less effect in removing hydrocarbon gas.

SUMMARY OF THE INVENTION

A PDP of the present invention includes a front panel and a rear panel disposed opposing each other, the front panel including a plurality of display electrodes, and the rear panel including barrier ribs forming discharge space. The rear panel includes a substrate, data electrodes formed crossing the display electrodes on the substrate, a dielectric layer covering the data electrodes, a reflective layer containing an oxidation catalyst and covering at least a part of the dielectric layer, and a phosphor layer formed on the reflective layer.

According to such a configuration, impurity gas inside the PDP is decomposed by an oxidation catalyst provided in the reflective layer so as to reduce the impurity gas influencing the deterioration of a phosphor. Furthermore, these oxidation catalysts can be provided in contact with the phosphor layer, so that impurity gas influencing the phosphor can be reduced more effectively.

REFERENCE MARKS IN THE DRAWINGS

Figure 1:
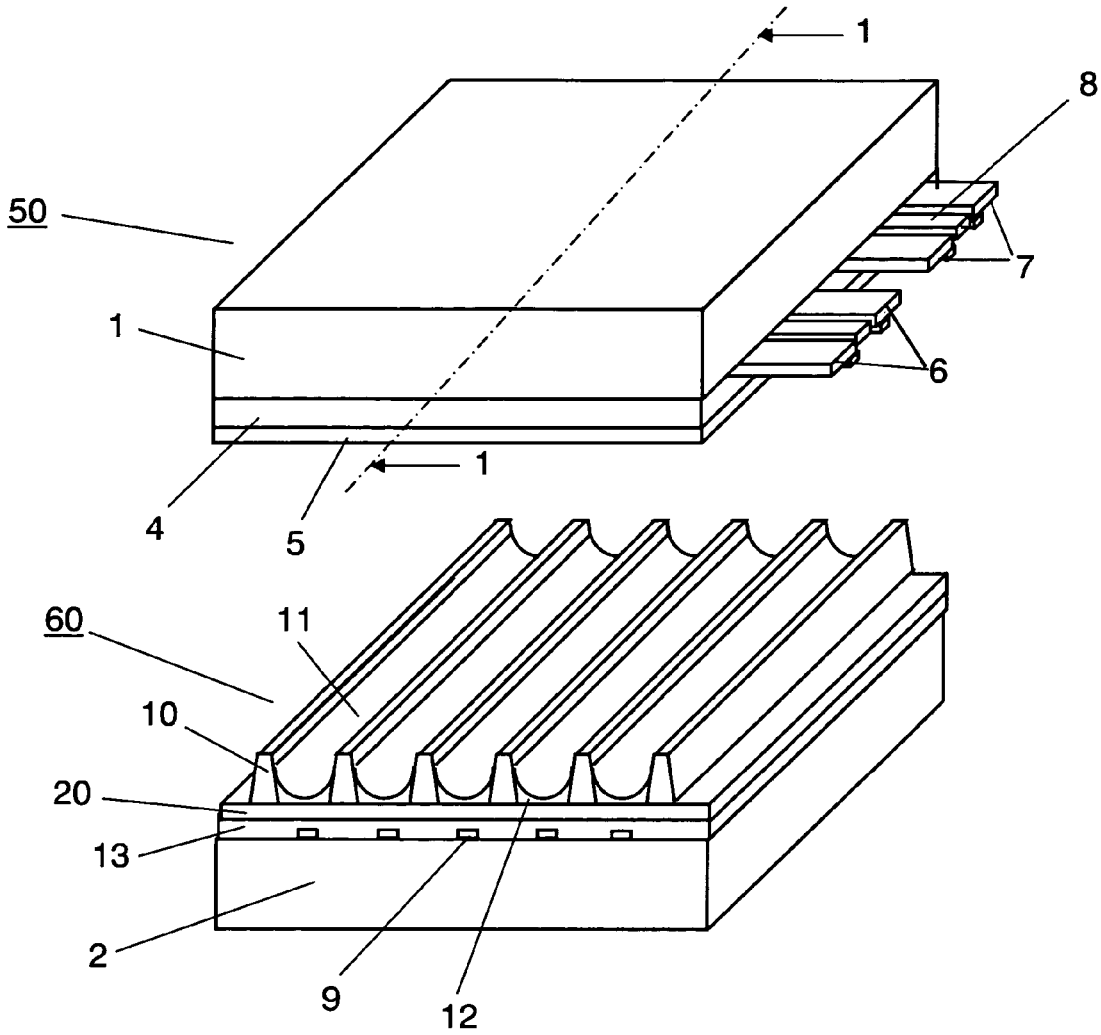
FIG. 1 is an exploded perspective view showing a PDP in accordance with a first exemplary embodiment of the present invention.

1 front substrate
2 rear substrate
3 discharge space
4, 13 dielectric layer
5 protective film
6 scan electrode
6*a*, 7*a* transparent electrode
6*b*, 7*b* metal bus line
7 sustain electrode
8 light-absorbing layer
9 data electrode
10 barrier rib
10*a* longitudinal barrier rib
10*b* transverse barrier rib
10*c* second transverse barrier rib
11 discharge cell
12 phosphor layer
20, 21 reflective layer
50 front panel
60 rear panel

DETAILED DESCRIPTION OF THE PREFERRED EMBODIMENTS

Hereinafter, a PDP in accordance with exemplary embodiments of the present invention is described with reference to drawings.

First Exemplary Embodiment

Figure 2:
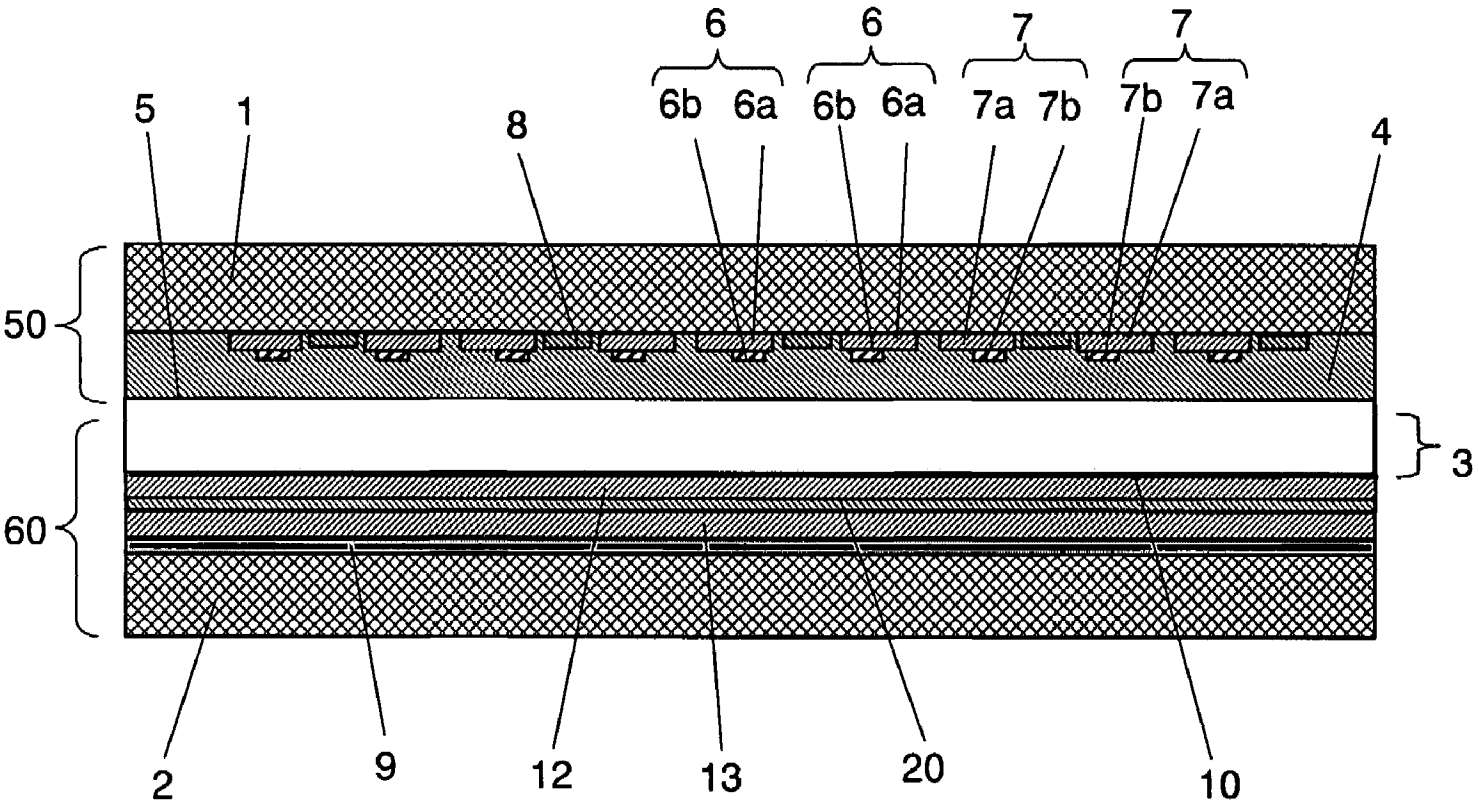
FIG. 2 is a sectional view taken along line 1-1 of FIG. 1.

FIG. 1 is an exploded perspective view showing a PDP in accordance with a first exemplary embodiment of the present invention. FIG. 2 is a sectional view taken along line 1-1 of FIG. 1.

As shown in FIGS. 1 and 2, a PDP has a configuration in which front panel 50 including front glass substrate 1 etc. and rear panel 60 including rear glass substrate 2, etc. are disposed opposing each other with discharge space 3 interposed therebetween, and front panel 50 and rear panel 60 are air-tightly sealed together with a sealing material (not shown) at the peripheries. In discharge space 3, discharge gas radiating ultraviolet ray by discharge, for example, neon (Ne) and xenon (Xe), is filled in at a pressure of 400 Torr (53.2 KPa) to 600 Torr (79.8 KPa).

On front substrate 1 of front panel 50, band-like display electrodes composed of a pair of scan electrodes 6 and sustain electrodes 7 are disposed in parallel to each other. Scan electrodes 6 and sustain electrodes 7 are respectively composed of transparent electrodes 6*a* and 7*a* and metal bus lines 6*b* and 7*b* which are superimposed on transparent electrodes 6*a* and 7*a* and are made of silver, etc. for enhancing conductivity. In this exemplary embodiment, two scan electrodes 6 and two sustain electrodes 7 are alternately arranged in an arrangement of scan electrode 6-scan electrode 6-sustain electrode 7-sustain electrode 7 . . . . Light absorbing layer 8 is provided between two neighboring sustain electrodes 7 and between two neighboring scan electrodes 6, respectively, and is made of black material etc. for enhancing the contrast when light is emitted. On the front substrate 1, dielectric layer 4 is formed so as to cover scan electrode 6, sustain electrode 7 and light-absorbing layer 8. Dielectric layer 4 is made of Pb—B glass and the like and serves as a capacitor. Furthermore, on dielectric layer 4, protective film 5 made of magnesium oxide (MgO) and the like is formed.

On rear substrate 2, a plurality of band-like data electrodes 9 are disposed in parallel to each other in the direction perpendicular to scan electrodes 6 and sustain electrodes 7. Dielectric layer 13 covers data electrodes 9. On dielectric layer 13, reflective layer 20 containing an oxidation catalyst is formed. Furthermore, on reflective layer 20, a plurality of barrier ribs 10 for partitioning discharge space 3 to form discharge cells 11 are provided in parallel to data electrodes 9. On the side surface of barrier rib 10 and on reflective layer 20, phosphor layer 12 is formed. As phosphor layers 12, phosphors emitting red, blue and green light by ultraviolet ray irradiation are formed alternately corresponding to respective data electrodes 9 provided on rear panel 60. As materials of the phosphors, $(Zn_{1-x}Mn_x)_2SiO_4$ ($0.01 \leqq x \leqq 0.25$) for a green phosphor, $Ba_{1-x}MgAl_{10}O_{17}:Eu_x$ or $Ba_{1-x-y}Sr_yMgAl_{10}O_{17}:Eu_x$ ($0.03 \leqq x \leqq 0.20$, $0.1 \leqq y \leqq 0.5$) for a blue phosphor, and $Y_{2(1-x)}O_3:Eu_{2x}$ or $(Y,Gd)_{1-x}BO_3:Eu_x$ ($0.05 \leqq x \leqq 0.20$) for a red phosphor are used, respectively.

As an oxidation catalyst in reflective layer 20, an oxidation catalyst containing a platinum group element is used. Reflective layer 20 is composed of such an oxidation catalyst and an oxide as a material for enhancing the reflecting effect. Reflective layer 20 includes white oxides such as $Al_2O_3$, ZnO, $SiO_2$, $Y_2O_3$, $TiO_2$ or $BaAl_2O_4$ as a main material and a platinum group element is added to these oxides. A method of adding a platinum group element into an oxide may include a solid phase method. In the solid phase method, a compound containing a platinum group element and an oxide are mixed well in a ball mill etc., and then the mixture is fired in the air, in nitrogen or in nitrogen-hydrogen at 300° C. to 600° C. for about two hours, followed by crushing and sieving thereof. In particular, for adding a platinum group element into an oxide uniformly, a liquid phase method may be carried out. In the liquid phase method, oxide powder is mixed into an aqueous solution of chloride and nitrate compound containing a platinum group element, and the mixed solution is stirred and then filtered. This mixed solution is dried, and then fired in the air, in nitrogen or in nitrogen-hydrogen at 300° C. to 600° C. The oxide containing a platinum group element absorbs impurity gas by the catalyst effect of the platinum group element, and additionally expresses the catalyst effect of oxidizing and decomposing (burning) hydrocarbon gas ($C_xH_y$ gas, or $C_xH_yO$ gas in which hydrocarbon is partially oxidized) in the absorbed impurity gas into water and carbon dioxide. The oxides constituting reflective layer 20 may contain any one or more materials from $Al_2O_3$, ZnO, $SiO_2$, $Y_2O_3$, $TiO_2$, and $BaAl_2O_4$.

It is preferable that as a raw material of the platinum group element to be added, an element such as Pt, Pd, Rh, Ir, Ru, or Os; chloride such as $PtCl_4$, $PdCl_2$, $RhCl_3$, $RuCl_3$, $IrCl_4$, or $OsCl_3$; or nitrate compound such as $Rh(NO_3)_3$ or $Ru(NO_3)_3$ is used. The added amount of the platinum group element is preferably in the range from 0.01% to 5% with respect to oxide and the platinum group element to be added may be any one or more of Pt, Pd, Rh, Ir, Ru and Os.

The oxide material containing a platinum group element, which was synthesized by this method, and an organic binder are kneaded to form a paste. By applying this paste onto dielectric layer 13 by a printing method, a dye coating method, and the like, reflective layer 20 in which an oxidation catalyst is dispersed can be formed.

In the manufacturing process of a PDP, in particular, in the process of sealing front panel 50 and rear panel 60, an organic binder contained in a glass frit, which is used as a sealing material and containing low-melting point lead glass and an inorganic oxide, is thermally decomposed at the time of heating and firing to generate impurity gas. The generated impurity gas is dispersed inside the PDP. Thereafter, by reducing the pressure in discharge cell 11 by the exhausting process, impurity gas is exhausted. However, on phosphor layer 12 etc. of discharge cell 11, water, carbon dioxide, hydrocarbon gas, or the like is adsorbed and remains. Although the amount of remaining hydrocarbon gas is as small as 1/100 to 1/1000 with respect to water, and 1/10 to 1/100 with respect to carbon dioxide, it is experimentally confirmed that when hydrocarbon gas is present in discharge cell 11, in particular, in phosphor layer 12, the hydrocarbon gas adversely influences the deterioration of discharge characteristics and degradation of phosphor property more than water or carbon dioxide. In particular, it is confirmed that hydrocarbon gas greatly influences a phosphor, in particular, a green phosphor of $Zn_2SiO_4$:Mn and a blue phosphor of $BaMgAl_{10}O_{17}$:Eu.

In this exemplary embodiment, in reflective layer 20 provided in the lower layer of phosphor layer 12, an oxidation catalyst containing a platinum group element is dispersed. The oxidation catalyst containing a platinum group element absorbs impurity gas by the catalyst effect of the platinum group element and further expresses the catalyst effect of oxidizing and decomposing (burning) hydrocarbon gas ($C_xH_y$ gas or $C_xH_yO$ gas in which hydrocarbon is partially oxidized) in the absorbed impurity gas into water and carbon dioxide. When hydrocarbon gas is oxidized and decomposed, water and carbon dioxide are further generated. However, the amount of hydrocarbon gas remaining inside the sealed PDP is as small as 1/100 or less as compared with water and carbon dioxide remaining inside the PDP. Therefore, the amount of water or carbon dioxide added by decomposition is relatively small, which has less influence on the deterioration of a phosphor.

A conventional method of adsorbing impurity gas by the use of a getter or simple adsorbent such as $SiO_2$, $Al_2O_3$ or $TiO_2$ adsorbed only water and carbon dioxide but did not have a function of decomposing hydrocarbon gas. Furthermore, in order to allow the getter to act effectively, a temperature of 400° C. or higher is necessary. In addition, during discharging, the getter or the adsorbent is exposed to plasma or heat, so that impurity gas is released to the inside of the PDP again. Therefore, the conventional method did not exhibit a sufficient effect of, in particular, removing hydrocarbon gas.

According to the first exemplary embodiment of the present invention, reflective layer 20 in which an oxidation catalyst containing a platinum group element is dispersed is provided in a lower layer of phosphor layer 12 over the entire region of the PDP. Consequently, hydrocarbon gas that is impurity gas adsorbed on phosphor layer 12 can be effectively removed by oxidation and decomposition. Furthermore, main oxide materials constituting reflective layer 20 are materials having an adsorption effect, for example, $TiO_2$, $Al_2O_3$, ZnO, $SiO_2$, or the like. Impurity gas adsorbed on such materials can be further taken up into oxidation catalysts and effectively oxidized and decomposed. Therefore, in addition to a conventional effect as a reflective layer, an effect of decomposing and removing, in particular, hydrocarbon gas as impurity gas is obtained. Thus, it is possible to provide a PDP in which a phosphor is less deteriorated and which is excellent in quality of image display and has high reliability.

Second Exemplary Embodiment

Figure 3:
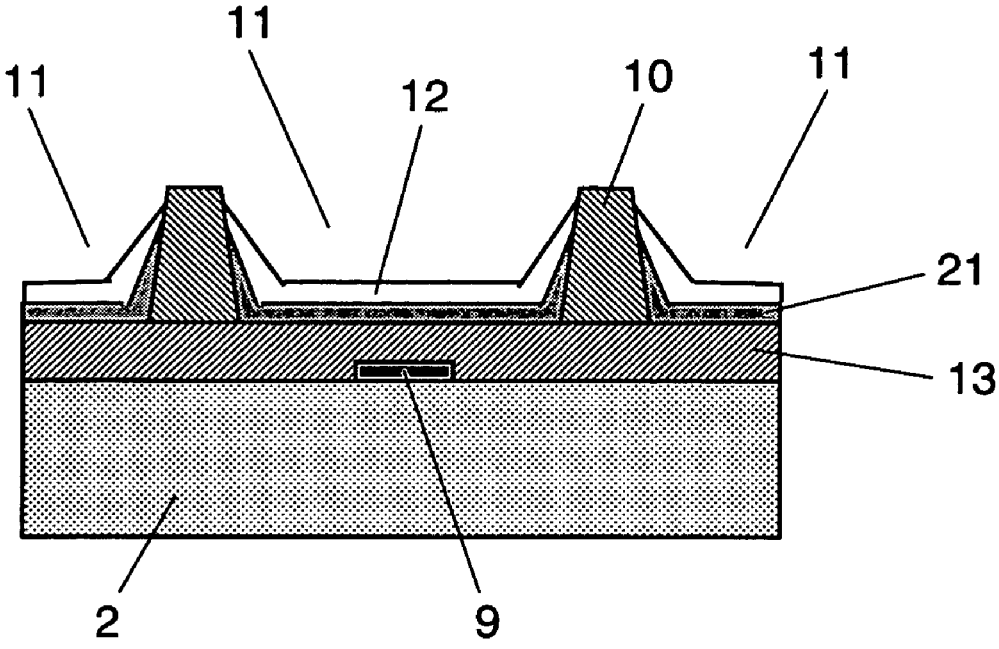
FIG. 3 is a sectional view showing a configuration of a rear panel of a PDP in accordance with a second exemplary embodiment of the present invention.

FIG. 3 is a sectional view showing a configuration of a rear panel of a PDP in accordance with a second exemplary embodiment of the present invention. Main configurations of a front panel and a rear panel of the PDP in the second exemplary embodiment are the same as those in the first exemplary embodiment and so description thereof omitted herein. As shown in FIG. 3, in the second exemplary embodiment, reflective layer 21 in which an oxidation catalyst is dispersed is formed on the entire surface of the inner wall of discharge cells 11. That is to say, barrier ribs 10 are formed on dielectric layer 13, and reflective layer 21 having the same material composition mentioned in the first exemplary embodiment in which an oxidation catalyst is dispersed is formed on the side surfaces of barrier ribs 10 and on dielectric layer 13 in discharge cells 11. Phosphor layer 12 is formed on reflective layer 21. As a method of forming such a reflective layer 21, similar to the method of forming phosphor layer 12, a printing method or a dispenser method, and the like may be applied. Therefore, according to this exemplary embodiment, the reflecting effect of reflective layer 21 can be further enhanced, the surface area and volume of the oxidation catalyst can be increased, and the removing effect of impurity gas by the catalyst effect can be further enhanced.

Table 1 shows the measurement results of the amount of hydrocarbon gas adsorbed on phosphor layer 12 inside the PDP and the rate of change in luminance in the second exemplary embodiment of the present invention. Samples Nos. 1 to 6 in Table 1 show the results when kinds of oxides constituting reflective layer 21 and platinum group elements are varied. Sample No. 7 shows a comparative example in which a reflective layer contains only $TiO_2$ and does not contain an oxidation catalyst, and sample No. 8 shows a comparative example in which a reflective layer is not included. The amount of hydrocarbon gas in Table 1 was measured by the use of TDS (Thermal Desorption Spectroscopy) by destroying a sealed PDP and taking out only phosphor. The rate of change in luminance was measured by an accelerated life test by driving the PDP for 5000 hours while applying voltage of 180V and discharge-sustaining pulse of frequency of 50 kHz to the PDP. When the PDP is made all-green display and all-blue display before and after driving of 5000 hours, the luminance is measured by a luminance meter and the rate of change in luminance is calculated from the following equation.

{(luminance after pulse is applied−luminance before pulse is applied)/luminance before pulse is applied}×100(%)

The change in luminance of the phosphor due to hydrocarbon gas largely influences a phosphor material, in particular, a green phosphor of $Zn_2SiO_4$:Mn and a blue phosphor of $BaMgAl_{10}O_{17}$:Eu. Thus, in this exemplary embodiment, PDPs using these phosphors were produced and the rates of change in luminance of the PDPs were measured.

Furthermore, the amount of hydrocarbon gas in the phosphor is shown as follows. The adsorption ratio of hydrocarbon gas occupied in the entire gas of sample No. 1 is made to be 1 and those of other samples are shown as relative values.

[Table 1]

TABLE 1

| Sample number | Composition of reflective layer | Adsorption amount of hydrocarbon in phosphor (*1) | Rate of change in luminance of panel after 5000 hours of use (%) (*2) Green (%) | Blue (%) |
|---|---|---|---|---|
| 1 | Pt is added to $TiO_2$ | 1 | −1.2 | −1.5 |
| 2 | Rh is added to mixed powder of $TiO_2$ and $Al_2O_3$ | 0.8 | −1 | −1.3 |
| 3 | Pd is added to $Al_2O_3$ | 0.7 | −0.8 | −1.2 |
| 4 | Ir is added to ZnO | 1.5 | −1.3 | −1.8 |
| 5 | Os is added to $Y_2O_3$ | 1 | −1 | −1.4 |
| 6 | Ru is added to $BaAl_2O_4$ | 0.8 | −0.9 | −1.1 |
| 7* | Only $TiO_2$ | 98 | −9.5 | −10.5 |
| 8* | No reflective layer | 105 | −10.1 | −11.8 |

Note:
1. Sample Nos. 7 and 8 show comparative examples
2. (*1) Relative value when the adsorption amount of sample No. 1 is made to be 1 as a reference
3. (*2) Rate of change in luminance when panel is driven at discharge-sustaining voltage of 180 V, at 50 kHz for 5000 hours As shown in Table 1, in sample No. 8 without having a reflective layer, the adsorption amount of hydrocarbon gas in the phosphor is large and the rates of change in luminance of green and blue are as large as −10.1% and −11.8%, respectively. In sample No. 7 having only $TiO_2$ as the reflective layer, adsorption ratio of hydrocarbon gas and the rate of change in luminance are slightly improved, but the rate of change in luminance is still large. On the other hand, in sample Nos. 1 to 6 of the PDP of the second exemplary embodiment of the present invention, the adsorption ratio of hydrocarbon gas in the phosphor is reduced to about 1/100 and the rate of change in luminance is also improved to almost 1/10.

Furthermore, in the secondary exemplary embodiment, a coloring pigment of a color corresponding to a color of emitted light of phosphor layer 12 may be mixed into reflective layer 21. That is to say, in reflective layer 21 provided under phosphor layer 12 emitting red light, a red coloring pigment such as $Fe_2O_3$ or $Mn_2O_3$ is mixed. In reflective layer 21 provided under phosphor layer 12 emitting green light, a green coloring pigment such as NiO—CoO—ZnO—$TiO_2$ or $Cr_2O_3$ is mixed. In reflective layer 21 provided under phosphor layer 12 emitting blue light, a blue coloring pigment such as $CoAl_2O_4$, CoO or CuO is mixed. With such a configuration, when light incident into a panel from the outside and reaching reflective layer 21 is reflected by reflective layer 21, since in reflective layer 21, the reflection factor of light of colors other than the color of emitted light of phosphor layer 12 formed thereon is small, the reflection of light of colors other than the color of emitted light of phosphor layer 12 is suppressed. As compared with the case in which a coloring pigment is not mixed in reflective layer 21, the contrast can be improved. Furthermore, these coloring pigments have an effect of adsorbing impurity gas such as hydrocarbon gas, so that the impurity gas adsorbed on these coloring pigments is taken up into oxidation catalyst and effectively oxidized and decomposed. Therefore, in particular, the oxidation and decomposition of hydrocarbon gas as an impurity gas can be promoted.

Therefore, according to the exemplary embodiment of the present invention, in addition to the effect as a reflective layer, by the oxidation catalyst effect of the oxidation catalyst contained in the reflective layer, impurity gas influencing the deterioration of the luminance of the phosphor can be considerably reduced, thus realizing highly reliable and high quality PDP.

Third Exemplary Embodiment

Figure 4:
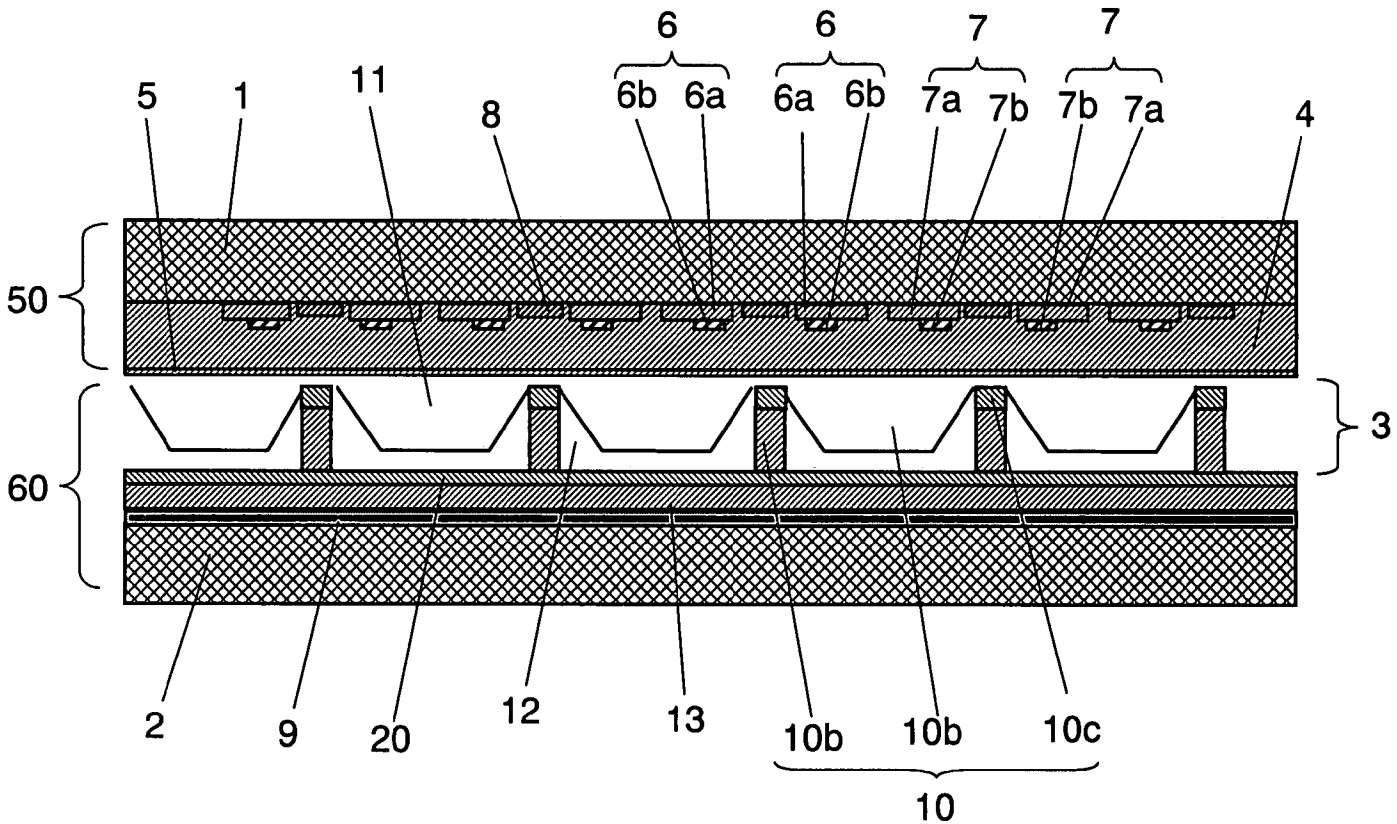
FIG. 4 is a sectional view showing a configuration of a PDP in accordance with a third exemplary embodiment of the present invention.
Figure 5:
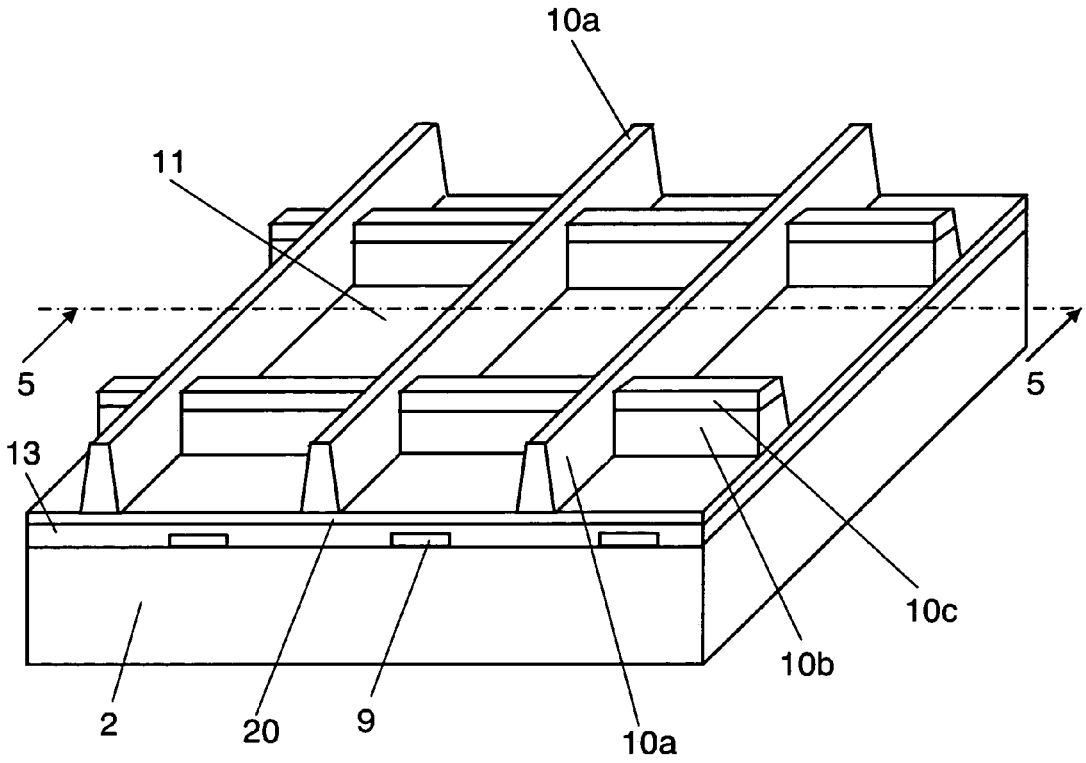
FIG. 5 is a perspective view showing a rear panel of the PDP.

FIG. 4 is a sectional view showing a configuration of a PDP in accordance with a third exemplary embodiment of the present invention. FIG. 5 is a perspective view showing a rear panel. Main configurations of a front panel and a rear panel of the PDP in the third exemplary embodiment are the same as those in the first exemplary embodiment and detailed configuration of the rear panel is different.

As shown in FIG. 4, on the rear substrate 2, a plurality of band-like data electrodes 9 are disposed in parallel to each other in the direction perpendicular to scan electrodes 6 and sustain electrodes 7. Dielectric layer 13 covers data electrodes 9. On dielectric layer 13, reflective layer 20 containing an oxidation catalyst is formed. Furthermore, on reflective layer 20, barrier ribs 10 are provided and partition discharge space 3 to form discharge cells 11.

As shown in FIGS. 4 and 5, barrier ribs 10 are composed of longitudinal barrier ribs 10*a* as first barrier ribs extending in the direction perpendicular to scan electrodes 6 and sustain electrodes 7, that is, in the direction parallel to data electrodes 9 and transverse barrier ribs 10*b* as second barrier ribs crossing perpendicular to longitudinal barrier ribs 10*a*. Longitudinal barrier ribs 10*a* and transverse barrier ribs 10*b* are arranged in parallel crosses. Furthermore, on the upper part of transverse barrier rib 10*b* that is second barrier rib, second transverse barrier rib 10*c* that is a third barrier rib is formed.

Longitudinal barrier ribs 10*a*, transverse barrier ribs 10*b* and second transverse barrier ribs 10*c* partition discharge cells 11. On the side surfaces of longitudinal barrier ribs 10*a* and transverse barrier ribs 10*b* of discharge cells 11 and on reflective layer 20, phosphor layer 12 is formed. Phosphor layer 12 forms phosphors emitting red, blue and green light alternately due to ultraviolet ray irradiation corresponding to respective data electrodes 9 provided on rear panel 60. As materials of the phosphors, $(Zn_{1-x}Mn_x)_2SiO_4$ ($0.01 \leqq x \leqq 0.25$) for a green phosphor, $Ba_{1-x}MgAl_{10}O_{17}:Eu_x$ or $Ba_{1-x-y}Sr_yMgAl_{10}O_{17}:Eu_x$ ($0.03 \leqq x \leqq 0.20$, $0.1 \leqq y \leqq 0.5$) for a blue phosphor, and $Y_{2(1-x)}O_3:Eu_{2x}$ or $(Y,Gd)_{1-x}BO_3:Eu_x$ ($0.05 \leqq x \leqq 0.20$) for a red phosphor are used, respectively.

Figure 6:
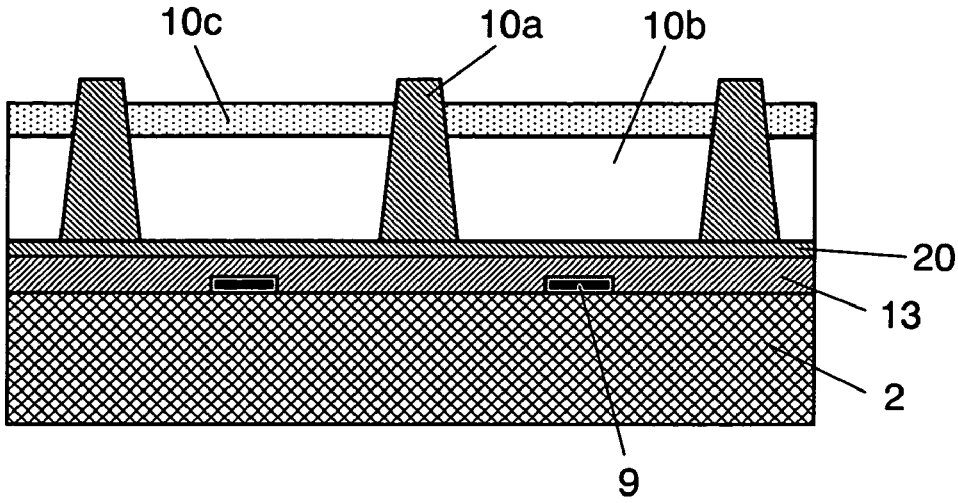
FIG. 6 is a sectional view taken along line 5-5 of FIG. 5 when space is provided between a third barrier rib and a front panel in the PDP.
Figure 7:
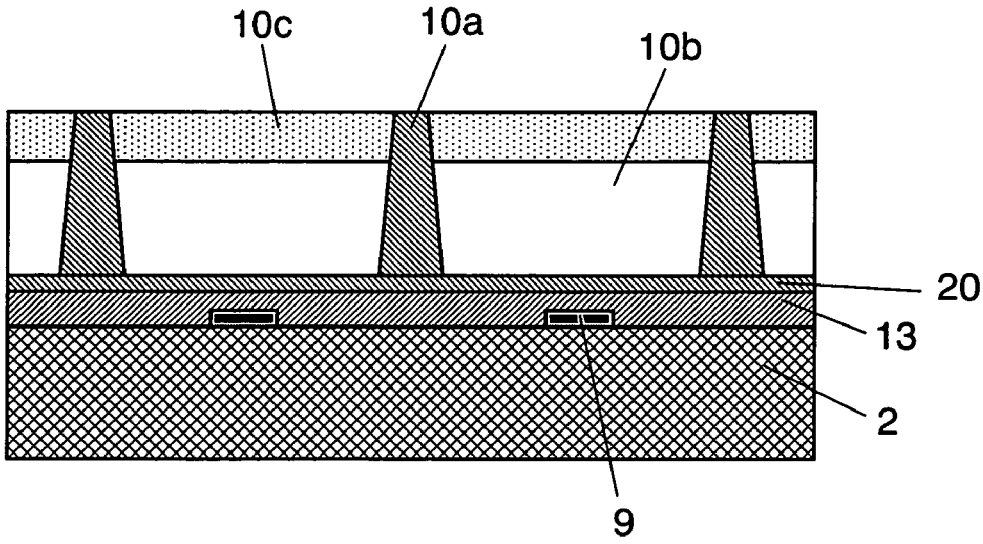
FIG. 7 is a sectional view taken along line 5-5 of FIG. 5 when space is not provided between a third barrier rib and a front panel in the PDP.

The height of transverse barrier rib 10*b* is lower than that of longitudinal barrier rib 10*a*. Barrier ribs 10*b* and 10*a* crossing perpendicular to each other have level difference in the crossing portion. At the upper parts of transverse barrier ribs 10*b*, second transverse barrier ribs 10*c* are formed. The configuration in which second transverse barrier ribs 10*c* are formed on the upper parts of transverse barrier ribs 10*b* can include the following forms. Such forms are shown in FIGS. 6 and 7 as sectional view taken along line 5-5 of FIG. 5. FIG. 6 shows the case in which the height of the top of second transverse barrier rib 10*c* is lower than that of longitudinal barrier rib 10*a* and has space between second transverse barrier ribs 10*c* and front panel 50. FIG. 7 shows the case in which the height of the top of second transverse barrier rib 10*c* is the same as that of longitudinal barrier rib 10*a*. In FIGS. 6 and 7, a phosphor layer is not shown.

Second transverse barrier rib 10*c* that is a third barrier rib is formed of an oxide containing an oxidation catalyst including a platinum group element. A method of adding a platinum group element into an oxide may include a solid phase method. In the solid phase method, a compound containing a platinum group element and an oxide are mixed well in a ball mill etc., and then the mixture is fired in the air, in nitrogen or in nitrogen-hydrogen at 300° C. to 600° C. for about two hours, followed by crushing and sieving thereof. In particular, for adding a platinum group element into an oxide uniformly, a liquid phase method may be carried out. In the liquid phase method, oxide powder is mixed into an aqueous solution of chloride and nitrate compound containing a platinum group element, and the mixed solution is stirred and then filtered. This mixed solution is dried, and then fired in the air, in nitrogen or in nitrogen-hydrogen at 300° C. to 600° C. The oxide containing a platinum group element absorbs impurity gas by the catalyst effect of the platinum group element, and additionally exhibits the catalyst effect of oxidizing and decomposing (burning) hydrocarbon gas ($C_xH_y$ gas, or $C_xH_yO$ gas in which hydrocarbon is partially oxidized) in the absorbed impurity gas into water and carbon dioxide.

Furthermore, any raw materials of oxide may be used as long as they have a heat resistant property. However, in particular, it is preferable that any one or more of $Al_2O_3$, ZnO, $SiO_2$, MgO, NiO, $Y_2O_3$, $MnO_2$, $Mn_2O_3$, $Ag_2O$, CuO, $Fe_2O_3$, CoO, $Co_2O_3$, $CO_3O_4$, PdO, $Cr_2O_3$, $ZrO_2$, etc., or $CaAl_2O_4$, $BaAl_2O_4$, $BaFe_2O_4$, $MgAl_2O_4$, $ZnAl_2O_4$, etc. It is preferable that as a raw material of the platinum group element to be added, an element such as Pt, Pd, Rh, Ir, Ru or Os; chloride such as $PtCl_4$, $PdCl_2$, $RhCl_3$, $RuCl_3$, $IrCl_4$ or $OsCl_3$; or nitrate compound such as $Rh(NO_3)_3$ or $Ru(NO_3)_3$ is used. The added amount of the platinum group element is preferably in the range from 0.01% to 5% with respect to oxide and platinum group element to be added may be any one or more of Pt, Pd, Rh, Ir, Ru and Os.

The oxide material containing a platinum group element, which was synthesized by this method, and an organic binder are kneaded to form a paste. By applying this paste onto a predetermined region of the upper part of transverse barrier rib 10*b* by a printing method, a dispenser method, and the like, second transverse barrier rib 10*c* is formed.

In this way, in the third exemplary embodiment of the present invention, a reflective layer containing an oxidation catalyst described in the first exemplary embodiment is provided and furthermore, a part of the barrier ribs are composed of oxide containing an oxidation catalyst.

In the third exemplary embodiment, on the upper part of the transverse barrier rib 10*b* having a lower height in barrier rib 10, second transverse barrier rib 10*c* of oxide containing an oxidation catalyst added with a platinum group element is formed. Therefore, second transverse barrier rib 10*c* absorbs impurity gas by the catalyst effect of the platinum group element and further expresses the catalyst effect of oxidizing and decomposing (burning) hydrocarbon gas ($C_xH_y$ gas or $C_xH_yO$ gas in which hydrocarbon is partially oxidized) in the absorbed impurity gas into water and carbon dioxide. According to the third exemplary embodiment of the present invention, an oxidation catalyst can be provided in barrier rib 10 that is the closest to phosphor layer 12 over the entire region of PDP. Consequently, it is possible to effectively oxidize, decompose and remove hydrocarbon gas that is impurity gas adsorbed on phosphor layer 12 and it is also possible to effectively oxidize and decompose hydrocarbon gas released into discharge cell 11. Thus, a PDP can be provided in which a phosphor is less deteriorated and which is excellent in quality of image display and has high reliability.

Furthermore, according to the third exemplary embodiment, since a part of barrier ribs 10 arranged in parallel crosses is formed of second transverse barrier ribs 10*c* containing an oxidation catalyst, the volume and surface area of the oxidation catalyst can be increased, thus enabling the effect of the catalyst to be increased.

As shown in FIG. 6, the second transverse barrier ribs 10*c* can be formed with space provided between second transverse barrier ribs 10*c* and front panel 50. As shown in FIG. 7, second transverse barrier ribs 10*c* can be formed in contact with the front panel 50. However, by forming second transverse barrier rib 10*c* with space provided, exhaust in the exhausting process or filling in the filling of discharge gas can be carried out easily. Furthermore, in the third exemplary embodiment, the third barrier ribs containing an oxidation catalyst are provided on transverse barrier ribs 10*b* crossing data electrodes 9, but they may be provided on longitudinal barrier ribs 10*a* that are parallel to data electrodes 9. Furthermore, they may be provided both on longitudinal barrier ribs 10*a* and transverse barrier ribs 10*b*.

Table 2 shows the measurement results of the amount of hydrocarbon gas adsorbed on phosphor layer 12 inside the PDP and the rate of change in luminance in the third exemplary embodiment. Samples Nos. 1 to 3 in Table 2 of this exemplary embodiment show an example in which second transverse barrier ribs 10*c* are formed with a thickness of about 20 μm on transverse barrier ribs 10*b* and space of about 10 μm is provided between second transverse barrier ribs 10*c* and front panel 50. The amount of hydrocarbon gas in Table 2 was measured by TDS (Thermal Desorption Spectroscopy) by destroying a sealed PDP and taking out only phosphor. The rate of change in luminance was measured by an accelerated life test by driving the PDP for 5000 hours while applying voltage of 180V and discharge-sustaining pulse of frequency of 50 kHz to the PDP. When the PDP is made all-green display and all-blue display before and after driving of 5000 hours, the luminance is measured by a luminance meter and the rate of change in luminance is calculated from the following equation.

{(luminance after pulse is applied−luminance before pulse is applied)/luminance before pulse is applied}×100(%)

The change in luminance of the phosphor due to hydrocarbon gas largely influences a phosphor material, in particular, a green phosphor of $Zn_2SiO_4$:Mn and a blue phosphor of $BaMgAl_{10}O_{17}$:Eu. Thus, in this exemplary embodiment, PDPs using these phosphors were produced and the rates of change in luminance of the PDPs were measured.

Sample No. 4 shows a comparative example in which the barrier rib is composed of only oxide, sample No. 5 shows a comparative example in which the barrier rib does not contain oxide, and sample No. 6 shows a comparative example in which even the reflective layer shown in FIGS. 4 and 5 is not included. Adsorption rate of hydrocarbon gas occupied in the entire gas in sample No. 1 of $Al_2O_3$ (oxide) containing Pt element is made to be 1.

[Table 2]

TABLE 2

| Sample number | Composition of reflective layer | Composition of third barrier rib: Kinds of oxides containing platinum group element | Composition of third barrier rib: Kinds of platinum group element | Adsorption amount of hydrocarbon in phosphor (*1) | Rate of change in luminance of panel after 5000 hours of use (%) (*2): Green (%) | Rate of change in luminance of panel after 5000 hours of use (%) (*2): Blue (%) |
|---|---|---|---|---|---|---|
| 1 | Pt is added to $TiO_2$ | $Al_2O_3$ | Pt | 1 | −0.9 | −1.2 |
| 2 | Pt is added to $TiO_2$ | MgO | Ir | 1.2 | −1.2 | −1.3 |
| 3 | Pt is added to $TiO_2$ | $MgAl_2O_4$ | Os | 0.7 | −0.6 | −0.9 |
| 4* | Pt is added to $TiO_2$ | $Al_2O_3$ | Not contained | 2.05 | −1.2 | −1.4 |
| 5* | Pt is added to $TiO_2$ | Not contained | Not contained | 2.5 | −1.2 | −1.5 |
| 6* | No reflective layer | Not contained | Not contained | 105 | −10.1 | −11.8 |

(Note)

1. Sample Nos. 4, 5 and 6 show comparative examples
2. (*1) Relative value when the adsorption amount of sample No. 1 is made to be 1 as a reference
3. (*2) Rate of change in luminance when panel is driven at discharge-sustaining voltage of 180 V, at 50 kHz for 5000 hours As shown in Table 2, in sample No. 6 including neither oxide nor reflective layer, the adsorption amount of hydrocarbon gas in the phosphor is large and the rates of change in luminance of green and blue are as large as −10.1% and −11.8%, respectively. However, similar to the second exemplary embodiment, even by only a reflective layer containing an oxidation catalyst, the adsorption ratio of hydrocarbon gas and the rate of change in luminance can be considerably improved. Furthermore, as sample No. 4, when second transverse barrier rib 10*c* contains only oxide, the adsorption ratio of hydrocarbon gas and the rate of change in luminance can be slightly improved. On the other hand, in sample Nos. 1 to 3 of the PDP of the third exemplary embodiment of the present invention, the adsorption ratio of hydrocarbon gas in the phosphor is reduced to about half of that of sample Nos. 4 and 5, and the rate of change in luminance is also improved.

Therefore, according to the third exemplary embodiment of the present invention, in addition to decomposition of hydrocarbon gas in the reflective layer, also in the barrier ribs, remaining hydrocarbon gas is decomposed. Thus, the purity of gas can be enhanced, and change in luminance of the phosphor can be suppressed.

In the third exemplary embodiment, an example of disposing oxidation catalysts both in the reflective layer and barrier ribs was described. However, the effect of decomposing hydrocarbon gas can be expressed by allowing only the barrier ribs to contain oxidation catalysts.

INDUSTRIAL APPLICABILITY

According to a PDP of the present invention, the amount of impurity gas inside the PDP can be considerably reduced and a PDP having high reliability, which has stable discharge characteristics and is free from change over time of luminance, can be realized. The PDP of the present invention can be useful for a large screen display device, and the like.

The invention claimed is:

1. A plasma display panel comprising:

a front panel and a rear panel disposed opposing each other, the front panel including a plurality of display electrodes, and the rear panel including barrier ribs forming a discharge space, wherein the rear panel comprises a substrate, data electrodes formed in a direction crossing the display electrodes on the substrate, a dielectric layer covering the data electrodes, a reflective layer containing an oxidation catalyst and covering at least a part of the dielectric layer, and a phosphor layer formed on the reflective layer, wherein the barrier ribs include a first barrier rib, a second barrier rib provided in a direction perpendicular to the first barrier rib, and a third barrier rib formed on an upper part of the second barrier rib, and wherein a space is provided between a top of the third barrier rib and the front panel.

2. The plasma display panel according to claim 1, wherein the reflective layer is formed on a side surface of at least one of the barrier ribs.

3. The plasma display panel according to claim 1, wherein the reflective layer is provided individually corresponding to the phosphor layer, and the reflective layer is mixed with a coloring pigment of a color corresponding to a color of emitted light of the phosphor layer provided on the reflective layer.

4. The plasma display panel according to claim 1, wherein the reflective layer is composed of any one or more materials selected from $Al_2O_3$, ZnO, $SiO_2$, $Y_2O_3$, $TiO_2$, and $BaAl_2O_4$.

5. The plasma display panel according to claim 1, wherein the third barrier rib comprises oxide containing the oxidation catalyst.

6. The plasma display panel according to claim 5, wherein the oxide is any one or more of the oxides selected from $Al_2O_3$, ZnO, $SiO_2$, MgO, NiO, $Y_2O_3$, $MnO_2$, $Mn_2O_3$, $Ag_2O$, CuO, $Fe_2O_3$, CoO, $CO_2O_3$, $CO_3O_4$, PdO, $Cr_2O_3$, $ZrO_2$, $CaAl_2O_4$, $BaAl_2O_4$, $BaFe_2O_4$, $MgAl_2O_4$ and $ZnAl_2O_4$.

7. The plasma display panel according to claim 1, wherein the oxidation catalyst contains a platinum group element.

8. The plasma display panel according to claim 7, wherein the platinum group element is any one or more of the elements selected from Pt, Rh, Pd, Ir, Os and Ru.

9. The plasma display panel according to claim 2, wherein the reflective layer is composed of any one or more materials selected from $Al_2O_3$, ZnO, $SiO_2$, $Y_2O_3$, $TiO_2$, and $BaAl_2O_4$.

10. The plasma display panel according to claim 3, wherein the reflective layer is composed of any one or more materials selected from $Al_2O_3$, ZnO, $SiO_2$, $Y_2O_3$, $TiO_2$, and $BaAl_2O_4$.

11. The plasma display panel according to claim 5, wherein the oxidation catalyst contains a platinum group element.

12. The plasma display panel according to claim 1, wherein the first barrier rib contacts the front panel.

13. The plasma display panel according to claim 1, wherein the second barrier rib comprises a plurality of second barrier ribs provided between a plurality of discharge cells surrounded by the first barrier rib, the front panel, and the rear panel, and the third barrier rib comprises a plurality of third barrier ribs provided on upper parts of the plurality of second barrier ribs, respectively.

* * * * *

UNITED STATES PATENT AND TRADEMARK OFFICE

CERTIFICATE OF CORRECTION

PATENT NO. : 7,271,538 B2
APPLICATION NO. : 10/558298
DATED : September 18, 2007
INVENTOR(S) : Kazuhiko Sugimoto et al.

It is certified that error appears in the above-identified patent and that said Letters Patent is hereby corrected as shown below:

In column 12, claim 6, line 23, "$CO_2O_3$" should be --$Co_2O_3$--.

In column 12, claim 6, line 23, "$CO_3O_4$" should be --$Co_3O_4$--.

In column 8, line 61, "$CO_3O_4$" should be --$Co_3O_4$--.

Signed and Sealed this

Eighteenth Day of March, 2008

JON W. DUDAS
*Director of the United States Patent and Trademark Office*